US009335114B2

(12) United States Patent
Yi et al.

(10) Patent No.: US 9,335,114 B2
(45) Date of Patent: May 10, 2016

(54) SELF-TUNABLE COMPOUND BOW

(71) Applicant: WIN & WIN Co., Ltd., Gyeonggi-do (KR)

(72) Inventors: Chang Ho Yi, Incheon (KR); Dong Won Park, Seoul (KR)

(73) Assignee: Win & Win Co., Ltd. (KR)

( * ) Notice: Subject to any disclaimer, the term of this patent is extended or adjusted under 35 U.S.C. 154(b) by 0 days.

(21) Appl. No.: 14/596,827

(22) Filed: Jan. 14, 2015

(65) Prior Publication Data

US 2015/0153132 A1 Jun. 4, 2015

Related U.S. Application Data

(63) Continuation-in-part of application No. 14/468,418, filed on Aug. 26, 2014.

(30) Foreign Application Priority Data

Aug. 30, 2013 (KR) ..... 10-2013-0104033
Dec. 23, 2013 (KR) ..... 10-2013-0161527

(51) Int. Cl.
*F41B 5/10* (2006.01)

(52) U.S. Cl.
CPC .. *F41B 5/105* (2013.01); *F41B 5/10* (2013.01)

(58) Field of Classification Search
CPC ..... F41B 5/10; F41B 5/105
USPC ..... 124/25.6
See application file for complete search history.

(56) References Cited

U.S. PATENT DOCUMENTS

| | | | | |
|---|---|---|---|---|
| 5,960,778 | A * | 10/1999 | Larson | F41B 5/10 124/25.6 |
| 6,691,692 | B1 | 2/2004 | Adkins | |
| 8,156,928 | B1 | 4/2012 | Blahnik | |
| 8,281,774 | B2 | 10/2012 | Grace | |
| 2004/0074485 | A1 * | 4/2004 | Cooper | F41B 5/10 124/25.6 |
| 2012/0000451 | A1 * | 1/2012 | Grace | F41B 5/10 124/25.6 |
| 2013/0068206 | A1 | 3/2013 | Langley | |
| 2015/0083099 | A1 | 3/2015 | Yi et al. | |

* cited by examiner

*Primary Examiner* — Gene Kim
*Assistant Examiner* — Jeffrey Vanderveen
(74) *Attorney, Agent, or Firm* — Berenato & White, LLC

(57) ABSTRACT

Provided is a self-tunable compound bow including: a bow main body including a pair of limbs that are respectively coupled to both ends of a handle; upper and lower pulley assemblies that are respectively coupled to the rear end of each limb; a bowstring; and first and second cam cables that are wound around a cam of each of the upper and lower pulley assemblies as the bowstring is pulled. A contact pin is formed in one of the pulley assemblies, in which the contact pin is in contact with one limb when the bowstring is pulled, and an indicator is formed in the other of the pulley assemblies, in which the indicator is in contact with the other limb and moves when the bowstring is pulled in a guide hole formed in the pulley of the other of the pulley assemblies.

15 Claims, 8 Drawing Sheets

SELF-TUNABLE COMPOUND BOW

CROSS-REFERENCE TO RELATED APPLICATION

This application is a continuation-in-part of U.S. application Ser. No. 14/468,418, filed Aug. 26, 2014, which claims the benefit of Korean Patent Application No. 10-2013-0104033, filed on Aug. 30, 2013, and No. 10-2013-0161527, filed on Dec. 23, 2013 in the Korean Intellectual Property Office, the disclosures of which are incorporated herein in their entirety by reference.

BACKGROUND OF THE INVENTION

1. Field of the Invention

The present invention relates to a compound bow, and more particularly, to a self-tunable compound bow which can self-align length of cam cables alone so that rotational angles of upper and lower cams become identical when a bowstring has been pulled.

2. Description of the Related Art

Typically, compound bows are configured so that a bowstring may be easily pulled without using a large force and arrow shooting power is increased during shooting, by using an effect of a cam or wheel, to thus result in a fast speed of an arrow and have very strong power, and are widely used mainly for hunting.

As shown in FIGS. 1 and 2, a conventional compound bow is configured to have upper limbs 20 that are coupled to the upper portion of a handle 10 at the center of which a grip portion is formed, and lower limbs 26 coupled to the lower portion of the handle 10. A cut-out portion 21 is formed between the upper limbs 20 whose edges 22 are spaced apart from each other, and a cut-out portion 27 is formed between the lower limbs 26 whose edges 28 are spaced apart from each other. Rotating shafts 70 are horizontally formed through the edges 22 of the upper limbs 20 and the cut-out portion 21, and through the edges 28 of the lower limbs 26 and the cut-out portion 27, respectively. Upper and lower pulleys 30 and 36 are rotatably combined with the respective rotating shafts 70.

A bowstring 50 is wound along a guide groove of each pulley 30 or 36, and the respective ends of the bowstring 50 are combined with each pulley 30 or 36. In addition, a cam 32 or 38 rotating with the pulley 30 or 36 is coupled in each pulley 30 or 36. As the bowstring 50 is pulled, cam cables 40 and 46 are formed so as to be wound on the cams 32 and 38, respectively. One end of each cam cable 40 or 46 is coupled to a pulley 30 or 36 to which each cam 32 or 38 is coupled, and the other end of each cam cable 40 or 46 is coupled to each rotating shaft 70 at both sides of the cut-out portion 21 or 27 of each of the opposing limbs 20 and 26 in the form of Y-shaped buss cables 40*a* and 46*a*.

Further, a cable guard 60 is laterally mounted at one side of a center portion of a handle 10, in which the cable guard 60 pushes the cam cables 40 and 46 to one side of the bowstring 50 so that an arrow is not prevented from being shot during shooting. In addition, a slide 66 is movably mounted on the cable guard 60 in which the cam cables 40 and 46 are inserted into the slide 66.

When the bowstring 50 is pulled in the prior art compound bow that is configured as described above, the lower and upper pulleys 30 and 36 are rotated and thus the cams 32 and 38 coupled to the lower and upper pulleys 30 and 36 are rotated, to thereby wind and pull the cam cables 40 and 46. When the bowstring 50 is released in a let-off state, an arrow obtains a strong driving force by a strong elastic force of the bow which returns to an original position instantaneously.

However, due to the strength of the limbs 20 and 26 or a change in a point at which the bowstring 50 is pulled in the compound bow, the rotational angles of the upper and lower cams 32 and 38 may be changed when the bowstring 50 is pulled and thus is at a let-off state. In this case, since both the two cams 32 and 38 do not become at a let-off state, the original strength of the bow is not exhibited and the accuracy of an arrow is reduced.

As described above, in the case that the rotational angles of the upper and lower cams 32 and 38 are changed, the lengths of the cam cables 40 and 46 may be adjusted in order to set the rotational angles of the upper and lower cams 32 and 38. However, it is difficult to determine difference in the rotational angles of the upper and lower cams 32 and 38, by a bowyer alone. As a result, since it is difficult to adjust the lengths of the cam cables, it is inconvenient for the other person to determine and tell difference in the rotational angles of the upper and lower cams 32 and 38 when a bowyer pulls the bowstring 50.

SUMMARY OF THE INVENTION

To solve the above conventional problems or defects, it is an object of the present invention to provide a self-tunable compound bow that enables a bowyer alone to set rotational angles of upper and lower cams identically.

To accomplish the above and other objects of the present invention, according to an aspect of the present invention, there is provided a self-tunable compound bow comprising:

a bow main body including a handle at a central portion of which a grip portion is formed and a pair of limbs that are respectively coupled to both ends of the handle;

upper and lower pulley assemblies each including a pulley that is rotatably coupled to a rotating shaft formed on the rear end of each limb, and a cam that is coupled to one side of the pulley and rotating with the pulley;

a bowstring whose either end is wound and coupled to the pulley of each of the upper and lower pulley assemblies; and first and second cam cables that are wound around the cam of each of the upper and lower pulley assemblies as the bowstring is pulled, in which one end of each of the first and second cam cables is coupled to one of the upper and lower pulley assemblies, and the other end thereof is coupled to the other of the upper and lower pulley assemblies;

wherein a contact pin is formed in one of the pulley assemblies, in which the contact pin is coupled to a coupling hole that is formed in the pulley of the one of the pulley assemblies, and is in contact with one limb to which the one of the pulley assemblies is coupled when the bowstring is pulled, and wherein an indicator is formed in the other of the pulley assemblies, in which the indicator is in contact with the other limb to which the other of the pulley assemblies is coupled and moves when the bowstring is pulled in a guide hole formed in the pulley of the other of the pulley assemblies.

Preferably but not necessarily, the indicator comprises a contact protrusion and a support member that are coupled to each other at both side surface of the guide hole, and the contact protrusion that contacts the other limb and the support member are coupled by two coupling members that are spaced apart from each other at a certain gap along the guide hole.

Preferably but not necessarily, one of the two coupling members is a bolt that couples the contact protrusion and the support member detachably.

Preferably but not necessarily, the other of the two coupling members is a coupling pin that is formed in the support member, and the coupling pin is inserted into and coupled to an insertion hole formed in the contact protrusion.

Preferably but not necessarily, a contact rubber pad is provided between the contact protrusion and the support member of the indicator, in which the contact rubber pad contacts the guide hole, and thus the indicator maintains an original position within the guide hole before the indicator contacts the other limb.

Preferably but not necessarily, a position display part is formed around the guide hole, in order to display a position to which the indicator moves while contacting the other limb.

Preferably but not necessarily, the coupling hole has a predetermined length and the contact pin is coupled at any position in the coupling hole.

Preferably but not necessarily, a plurality of the coupling holes are formed in which the contact pin is coupled to one of the plurality of the coupling holes.

ADVANTAGEOUS EFFECTS

As described above, the present invention provides a self-tunable compound bow that enables a bowyer alone to set rotational angles of upper and lower cams identically.

DETAILED DESCRIPTION OF THE INVENTION

The above and/or other objects and/or advantages of the present invention will become more apparent by the following description of embodiments of the present invention.

Hereinbelow, a self-tunable compound bow according to preferred embodiments of the present invention will be described in more detail with reference to the accompanying drawings.

Figure 1:
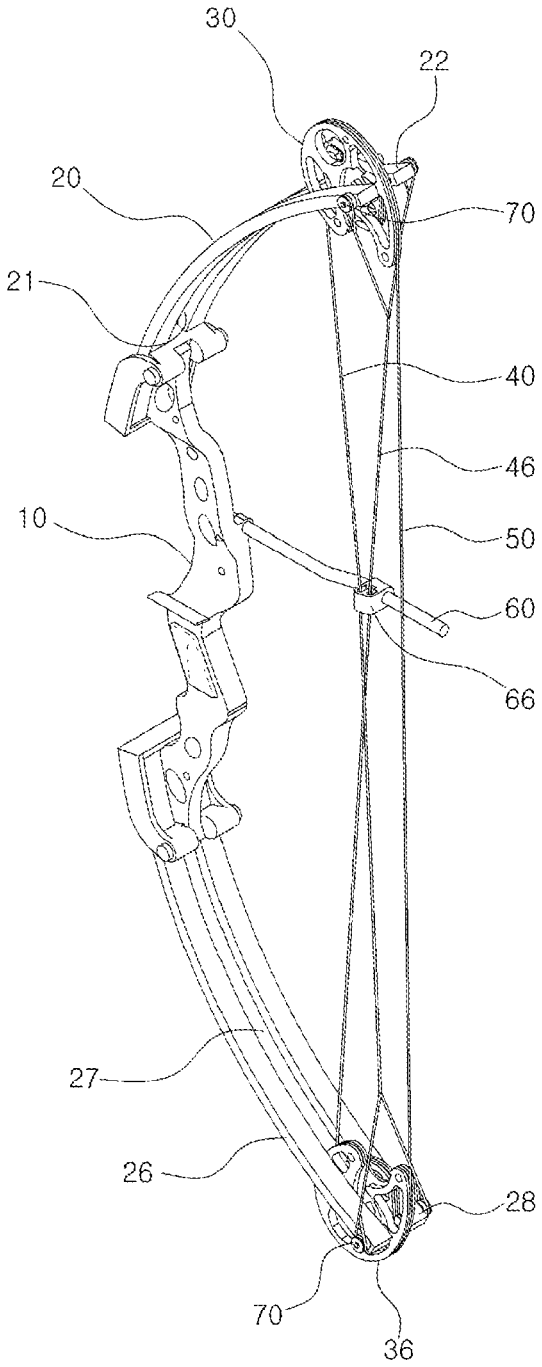
FIG.1 (PRIOR ART)
FIG. 1 is a perspective view of a conventional compound bow.
Figure 2:
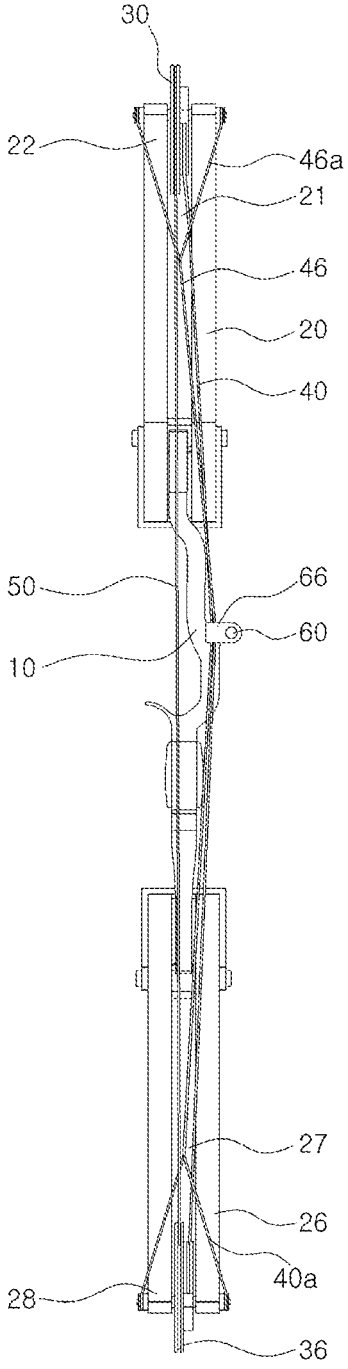
FIG.2 (PRIOR ART)
FIG. 2 is a rear view of the compound bow of FIG. 1 seen from the rear side thereof.
Figure 3:
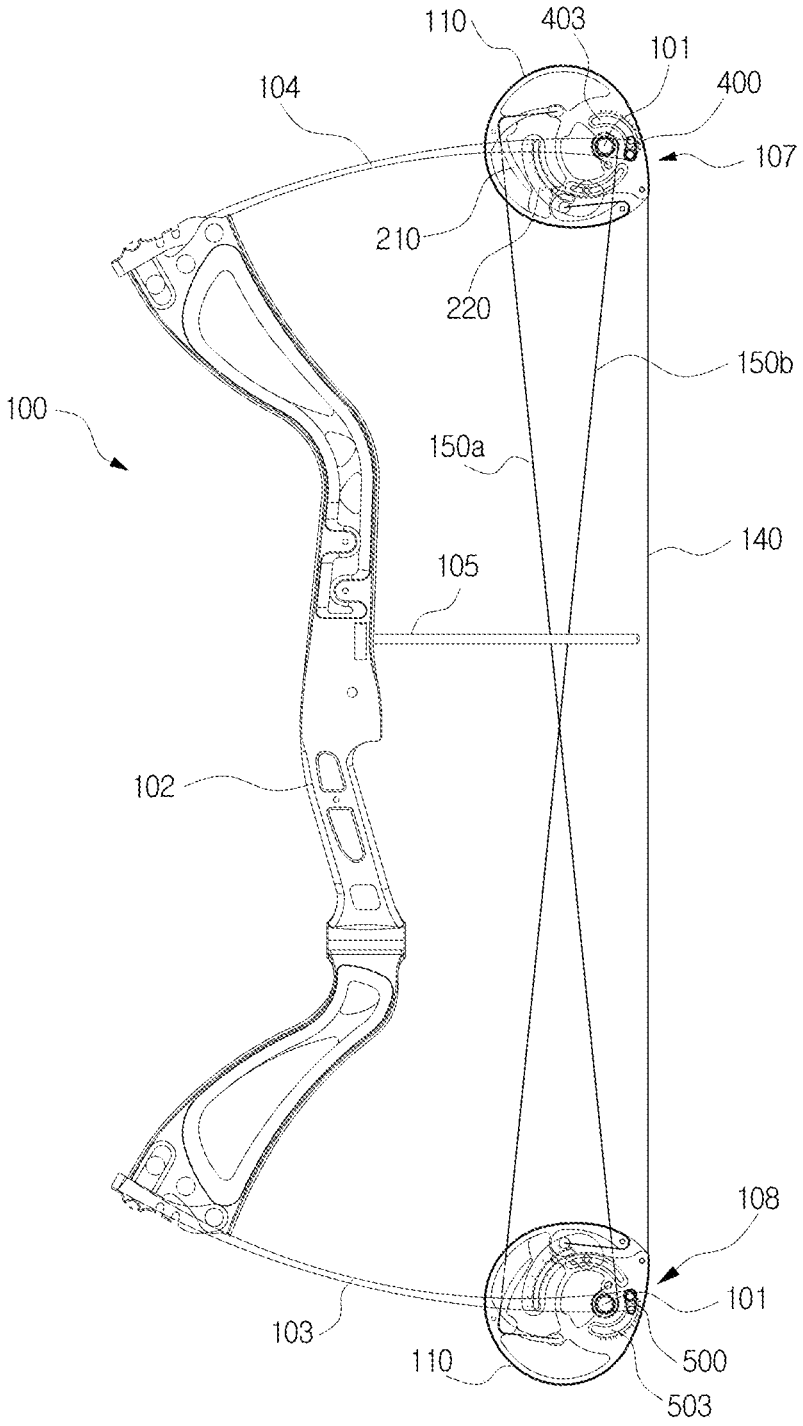
FIG. 3 is a side view showing a compound bow according to the present invention before a bowstring is pulled.
Figure 4:
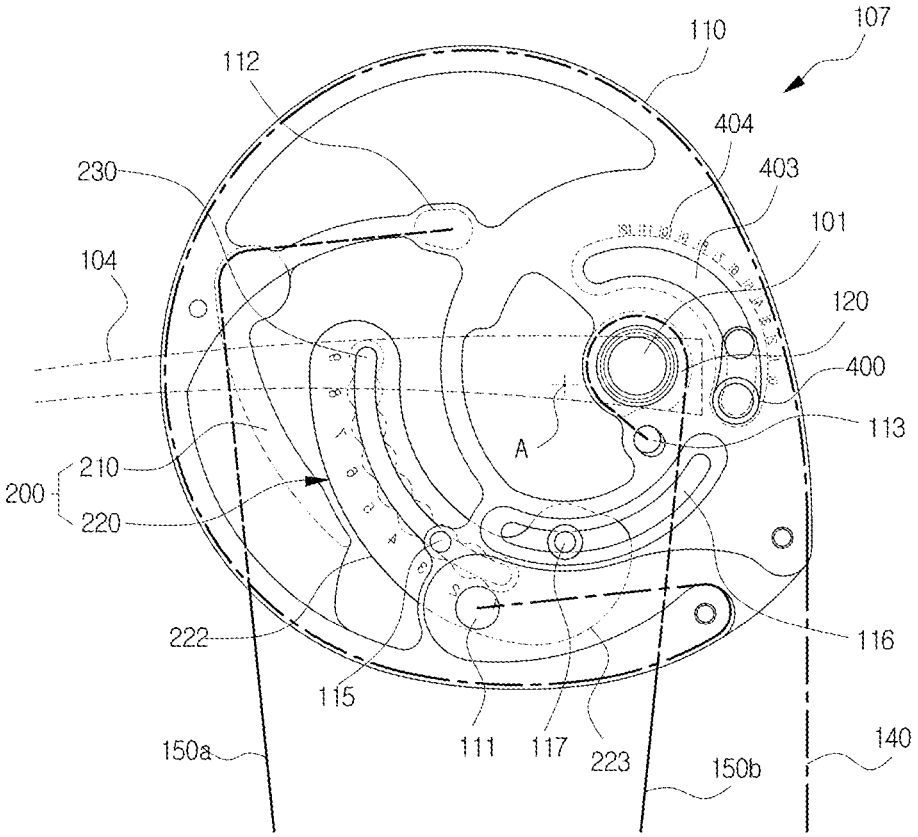
FIG. 4 is a detailed view of a pulley assembly that is coupled to one of limbs in FIG. 3.
Figure 5:
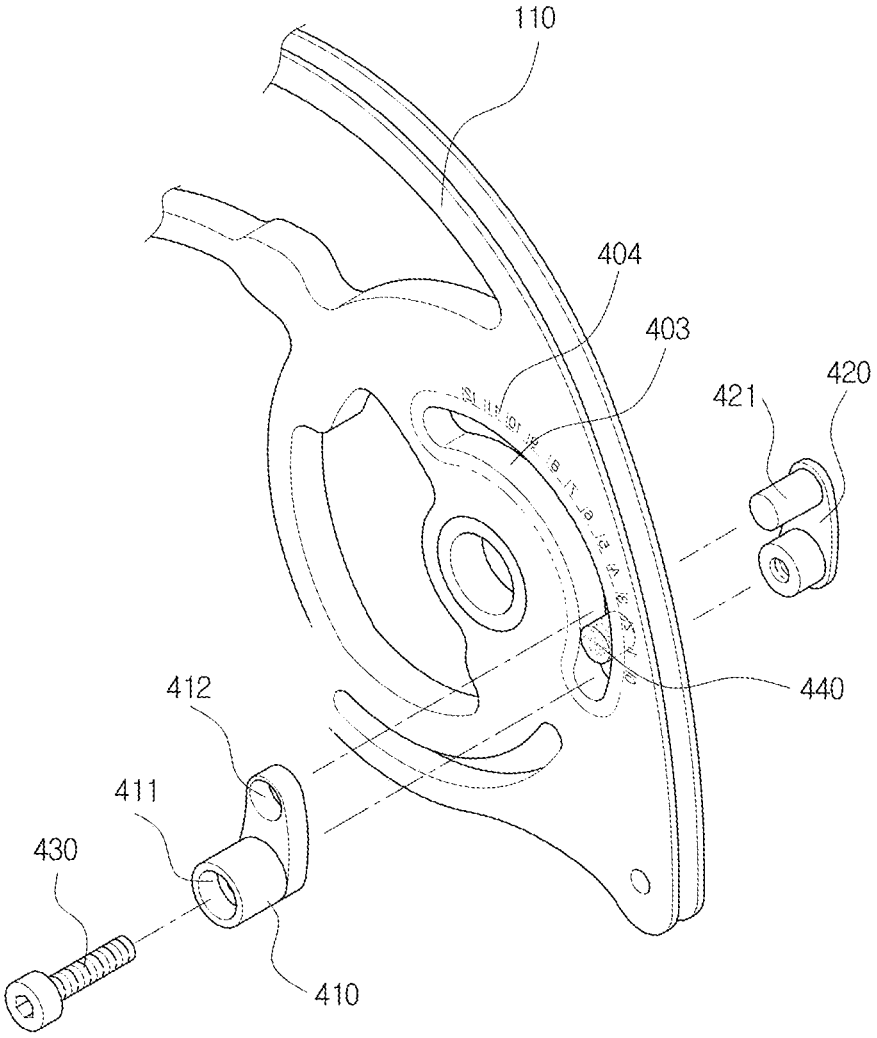
FIG. 5 is a partial exploded perspective view of FIG. 4.
Figure 6:
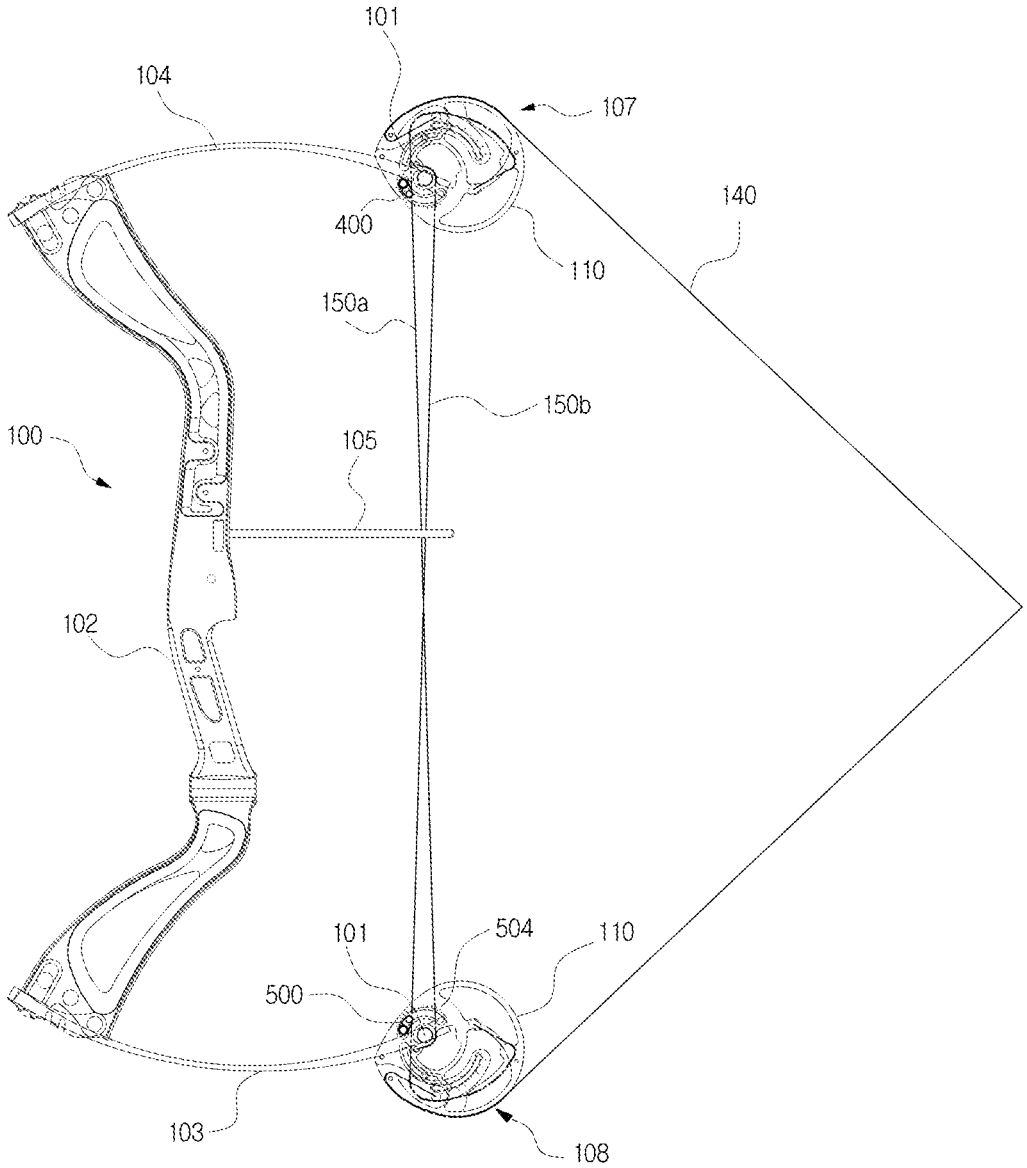
FIG. 6 is a side view showing the compound bow according to the present invention after a bowstring has been pulled.
Figure 7:
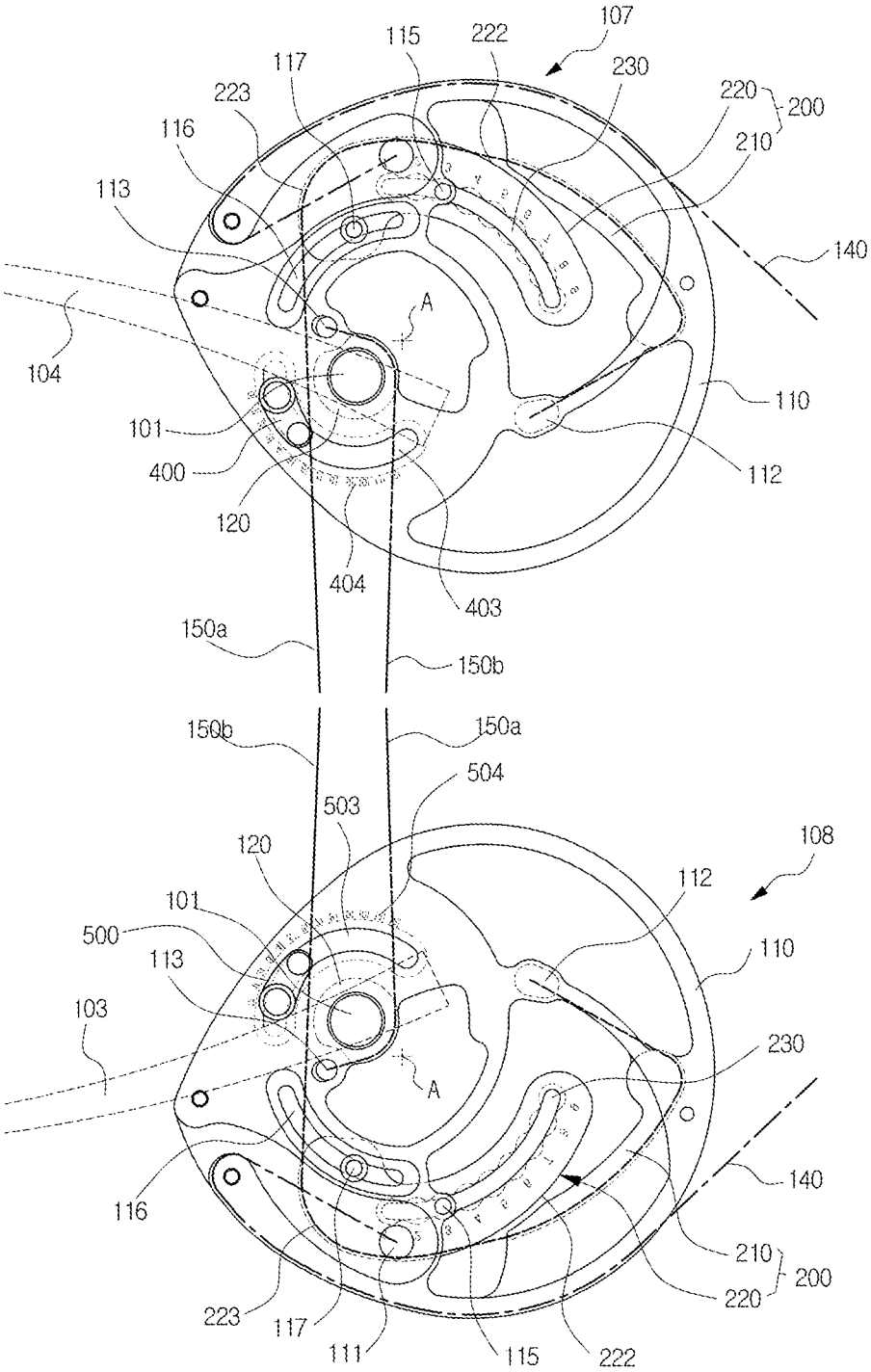
FIG. 7 is a side view showing upper and lower pulley assemblies in order to describe operation of an indicator in the compound bow according to the present invention.

FIG. 3 is a side view showing a compound bow according to the present invention before a bowstring is pulled. FIG. 4 is a detailed view of a pulley assembly that is coupled to one of limbs in FIG. 3. FIG. 5 is a partial exploded perspective view of FIG. 4. FIG. 6 is a side view showing the compound bow according to the present invention after a bowstring has been pulled. FIG. 7 is a side view showing upper and lower pulley assemblies in order to describe operation of an indicator in the compound bow according to the present invention.

Referring to FIGS. 3 to 7, a self-tunable compound bow according to a first embodiment of the present invention includes: a bow main body 100 including a pair of limbs 103 and 104 that are respectively coupled to both ends of a handle 102; upper and lower pulley assemblies 107 and 108 that are respectively coupled to the rear end of each limb 103 or 104; a bowstring 140; first and second cam cables 150*a* and 150*b* that are wound around a cam 200 of each of the upper and lower pulley assemblies 107 and 108 as the bowstring 140 is pulled; a contact pin 500 that is coupled to a coupling hole 503 formed in a pulley 110 of one pulley assembly 108; and an indicator 400 that is moved in contact with a limb 104 in a guide hole 403 formed in a pulley 110 of the other pulley assembly 107.

As shown, the compound bow according to the present invention employs a dual cam system the respective components of which will be described below in more detail. First, the bow main body 100 includes a handle 102 at a central portion of which a grip portion is formed so as to be gripped by a user, and a pair of limbs 103 and 104 that are respectively coupled to both ends of the handle 102 in which two branches are formed at the rear portion of each limb 103 or 104. A rotating shaft 101 is formed at the rear end of each limb 103 or 104, in which a pulley assembly 107 or 108 is rotatably coupled on the rotating shaft 101 between the two branches at the rear end of each limb 103 or 104. A cable guard 105 that pushes the cam cables 150*a* and 150*b* to one side of the bowstring 140 is coupled at the central portion of the handle 102, in order to prevent an arrow from being interrupted during shooting.

Then, each of the upper and lower pulley assemblies 107 and 108 is rotatably coupled to the rotating shaft 101 at the rear end of each limb 103 or 104, and includes: a pulley 110 that is rotatably coupled to the rotating shaft 101 formed at the rear end of each limb 103 or 104; and a cam 200 coupled to one side of the pulley 110 and rotating with the pulley 110, since the upper and lower pulley assemblies 107 and 108 are symmetrical with each other and have an identical configuration.

Each pulley 110 is formed of an oval-like plate-shaped member, and has an eccentric through-hole that is formed at the center of the pulley 110 and through which the rotating shaft 101 is coupled. Further, a guide groove that is depressed down to a predetermined depth is formed on the outer circumferential surface of each pulley 110 so that the bowstring 140 may be wound on the outer circumferential surface of each pulley 110. A fixing protrusion 111 for fixing one end of the bowstring 140 wound on the guide groove is formed at one side of each pulley 110. In addition, fixing protrusions 112 and 113 are formed in each pulley 110 in which the cam cables 150*a* and 150*b* are fixed to the fixing protrusions 112 and 113, respectively.

The cam 200 is formed in a pulley 110 and is rotated with rotation of the pulley 110, and includes: a cam cable winding portion 210 fabricated in an arc-shaped form and on which cam cables 150*a* and 150*b* are wound; and a cam module 220 that is rotatably coupled by a predetermined angle from the cam cable winding portion 210, around a pivot point "A" at a position spaced by a predetermined distance from a rotating shaft 101 of the pulley 110 to which the cam 200 is coupled, in which a cam cable winding groove is formed on the outer circumferential surface of the cam module 220, and the cam cables 150*a* and 150*b* are wound around the cam cable winding portion 210 and then sequentially wound on the outer circumferential surface of the cam module 220 when the bowstring 140 is pulled.

In addition, the cam 200 further includes a fixing unit that makes the cam module 220 rotated by a predetermined angle with respect to the pivot point "A" in order to control the draw length of the let-off state of the compound bow, and that makes the cam module 220 fixed to the pulley 110 at a position where the cam module 220 has been rotated.

The cam cable winding portion 210 is arc-shaped so that the cam cables 150*a* and 150*b* are wound on the cam cable winding portion 210, when the bowstring 140 is pulled, in which the cam cables 150*a* and 150*b* are respectively coupled to the fixing protrusions 112 and 113 that are located in the vicinity of the cam cable winding portion 210. In addition, a cam cable winding groove is formed on the outer circumferential surface of the cam cable winding portion 210 so that one of the cam cables 150*a* and 150*b* is wound on the outer circumferential surface of the cam cable winding portion 210.

The cam module 220 is rotatably coupled by a predetermined angle from the cam cable winding portion 210, around a pivot point "A" at a position spaced by a predetermined distance from a rotating shaft 101 of the pulley 110 to which the cam 200 is coupled, and is configured to have a gentle slope portion 222 formed of a gentle arc-shaped curve and a steep slope portion 223 that is extended from the gentle slope portion 222 to be close to the rotating shaft 101, to thus form a steep slope. Further, the cam cable winding grooves on which the cam cables 150*a* and 150*b* are wound are formed on the outer circumferential surfaces of the gentle slope portion 222 and the steep slope portion 223. Accordingly, the cam module 220 is rotated along with the pulley 110 when the bowstring 140 is pulled, and thus the cam cables 150*a* and 150*b* are sequentially wound on the gentle slope portion 222 and the steep slope portion 223 of the cam module 220 adjacent to the cam cable winding portion 210.

The fixing unit makes the cam module 220 fixed to the pulley 110 at a position where the cam module 220 has been rotated. To this end, an arc-shaped positioning hole 230 centered at the pivot point "A" is formed in the cam module 220, and a coupling hole (not shown) is formed in the pulley 110 to which the cam module 220 is coupled. Thus, when the cam module 220 is rotated by a predetermined angle around the pivot point "A", and a coupling member 115 is coupled to the coupling hole (not shown) formed in the pulley 110 at a predetermined position of the positioning hole 230, the cam module 220 is coupled to the pulley 110. In the present invention, when a bolt as the coupling member 115 is inserted into the positioning hole 230 and is screw-coupled into the coupling hole (not shown) formed in the pulley 110, the cam module 220 is coupled to the pulley 110. In addition, a position display part indicated by numbers are provided around the positioning hole 230, in order to display position at which the cam module 220 is fixed. The cam modules 220 that are respectively coupled to the upper and lower pulley assemblies 107 and 108 should have an identical rotational angle, and thus the position display part is indicated by numbers so as to see the rotational angle of each cam module 220. Of course, the position display part may be indicated by alphabetical letters instead of Arabic numbers.

The cam module 220 having such a structure in the present invention can adjust the draw length of the bowstring 140. Thus, when the cam module 220 of each of the upper and lower pulley assemblies 107 and 108 is identically rotated by an identical angle from the cam cable winding portion 210 around the pivot point "A" and the cam module 220 is again secured to the pulley 110 at a position where the cam module 220 has been rotated, the length of one of the cam cables 150*a* and 150*b* that is wound on the gentle slope portion 222 of the cam module 220 increases in comparison with the previous embodiment. At last, the length of one of the cam cables 150*a* and 150*b* that is wound from the cam cable winding portion 210 to the cam module 220 until the let-off state increases, to thereby increase the draw length of the bowstring 140.

The bowstring 140 is wound in the guide groove of the pulley 110 of each pulley assembly 107 or 108 and thus both ends of the bowstring 140 are coupled to the fixing protrusions 111 formed on the respective pulleys 110.

The cam cables 150*a* and 150*b* are formed between a pair of the limbs 103 and 104 of the bow main body 100 and are wound on the cams 200 formed in the respective pulleys 110, as the bowstring 140 is pulled. One end of each of the cam cables 150 *a* and 150*b* is coupled to the fixing protrusion 113 formed on the pulley 110 of one of the pulley assemblies 107 and 108, and then is wound around the rotating wheel 120 that is rotatably coupled to the rotating shaft 101, to then be extended toward the other one of the pulley assemblies 107 and 108, and the other end of each of the cam cables 150*a* and 150*b* is fixed to the fixing protrusion 112 of the pulley 110 of the other one of the pulley assemblies 107 and 108. Therefore, as the bowstring 140 is pulled, the cam cables 150*a* and 150*b* are wound on the cam 200 that is coupled to the other pulley 110 of the pulley assemblies 107 and 108.

The rotating wheel 120 is configured to have a through-hole at the center of the rotating wheel 120 in which the rotating shaft 101 of the pulley 110 is coupled into the through-hole, and is configured to be coupled to the rotating shaft 101 of the pulley 110 at a side surface of the pulley 110, and to be rotatably coupled to the rotating shaft 101 of the pulley 110 separately from the pulley 110. Further, the cam cable winding groove into which the cam cables 150*a* and 150*b* are wound is formed on the outer circumferential surface of the circular rotating wheel 120. Thus, the cam cables 150*a* and 150*b* are wound on the rotating wheel 120 and then one end of one of the cam cables 150*a* and 150*b* is coupled to the fixing protrusion 113 formed on the pulley 110 in the vicinity of the rotating wheel 120. The cam cables 150*a* and 150*b* are wound on the cam 200 of the other pulley 110 by the pulling of the bowstring 140, and accordingly a portion of the cam cables 150*a* and 150*b* wound on the rotating wheel 120 is released from the rotating wheel 120. Here, since the rotating wheel 120 is rotatably coupled to the rotating shaft 101 separately from the pulley 110, friction between each of the cam cables 150*a* and 150*b* and the rotating wheel 120 is reduced to thus reduce the pulling force of the bowstring 140.

As shown in FIGS. 4 and 5, an indicator 400 is moved in contact with the upper limb 104 in a guide hole 403 formed in the pulley 110 of the upper pulley assembly 107, as the bowstring 140 is pulled. The indicator 400 includes: a contact protrusion 410 and a support member 420 that are coupled to each other by two coupling members that are spaced apart from each other at a certain gap along the guide hole 403 at both side surface of the guide hole 403. One of the two coupling members is a bolt 430 that couples the contact protrusion 410 and the support member 420 separably, and the other one thereof is a coupling pin 421 that is spaced apart from the bolt 430 along the guide hole 403 and formed in the support member 420. Thus, a bolt hole 411 and a pin hole 412 that are respectively coupled to the bolt 430 and the coupling pin 421 are formed spaced apart with a gap from each other along guide hole 403 in the contact protrusion 410. In addition, the coupling pin 421 that is inserted into the pin hole 412 of the contact protrusion 410 is formed in the support member 420. Further, a bolt hole through which the bolt 430 is coupled is formed at a position spaced from the coupling pin 421.

The reason why the contact protrusion 410 and the support member 420 of the indicator 400 are coupled by the two coupling members is that the coupling members such as the bolt may be inclined due to a gap between a portion where the upper limb 104 contacts in the contact projection 410 and the guide hole 403 in the case that the contact protrusion 410 and the support member 420 are coupled with a single coupling member, and thus the indicator 400 is not smoothly in the guide hole 403. Therefore, according to the present embodiment, since the contact protrusion 410 and the support member 420 of the indicator 400 are coupled by the two coupling members that are spaced apart from each other at a certain gap along the guide hole 403, the indicator 400 can be smoothly moved in contact with the upper limb 104.

In addition, a contact rubber pad 440 is provided between the contact protrusion 410 and the support member 420 of the indicator 400, in which the contact rubber pad 440 is inserted in the guide hole 403 and contacts an inner circumferential surface of the guide hole 403. As shown in FIG. 5, the contact rubber pad 440 is fitted between the bolt 430 and the coupling pin 421 that are the two coupling members in the guide hole 403. Before the indicator 400 contacts the upper limb 104, the contact rubber pad 440 makes the indicator 400 maintained at an original position in the guide hole 403. When the indicator 400 contacts the upper limb 104, the contact rubber pad 440 plays a role of making the indicator 400 smoothly move in the guide hole 403.

The guide hole 403 to which the indicator 400 is coupled at a position in the upper pulley 110 in correspondence to the coupling hole 503 in the lower pulley 110, and is fabricated in an arc-shaped form centered at the rotating shaft 101.

As shown in FIGS. 3 to 7, the indicator 400 having such a configuration is rotated with the pulley 110 while maintaining the coupled position in the guide hole 403 at an initial time the bowstring 140 is pulled, but when the contact protrusion 402 comes to contact the upper limb 104, the pulley 110 continues to rotate and thus the contact protrusion 402 is pushed by the upper limb 104 to thus be moved in the guide hole 403. Accordingly, the indicator 400 is coupled to the guide hole 403, with strength enough to move in contact with the upper limb 104. Further, a position display part 404 is formed in the vicinity of the guide hole 403 in order to identify position where the indicator 400 is moved in the guide hole 403. The position display part 404 is configured to have a plurality of lines and numbers spaced apart from each other at intervals, like the position display part 504 in the vicinity of the coupling hole 503, but may be of alphabetic characters instead of numbers.

As shown in FIG. 7, a contact pin 500 is fixed and coupled at a position of a coupling hole 503 that has a predetermined length of an arc-shaped form and is formed in the pulley 110 of the lower pulley assembly 108 (e.g., at a position where the contact pin 500 contacts the lower limb 103 in a let-off state), in which the contact pin 500 contacts the lower limb 103 when the bowstring 140 is in a pulled state, that is, in a let-off state (called an arrow shooting state). In addition, the contact pin 500 is configured to have a contact protrusion that contacts the lower limb 103 and a support member like the indicator 400, and is separably coupled at both side surfaces of the coupling hole 503 by a bolt 530. The contact protrusion and the support member of the contact pin 500 are similar to those of the above-described indicator 400, and thus the detailed description thereof will be omitted.

As described above, the cam module 220 of each pulley assembly 107 or 108 may be identically rotated by a predetermined angle from the cam cable winding portion 210 around the pivot point "A" in order to adjust the draw length in the present invention. Here, since the rotational angle of each pulley 110 is changed in the let-off state according to movement of the cam module 220, position of the contact pin 500 is also moved accordingly. Here, the bolt 530 that couples the contact pin 500 to the coupling hole 503 is released to thus release the fixing of the contact pin 500. At the state where the fixing of the contact pin 500 has been released, the contact pin 500 is moved to a predetermined position in the coupling hole 503, and then the contact pin 500 is fixedly coupled to the coupling hole 503 again. The coupling hole 503 in which the contact pin 500 is moved is fabricated in an arc-shaped form around the rotating shaft 101. A position display part 504 is formed in the vicinity of the coupling hole 503 in order to identify position where the contact pin 500 is coupled. In the present embodiment, the position display part 504 is configured to have a plurality of lines and numbers spaced apart from each other at intervals, but may be of numeric or alphabetic characters.

The operation of the compound bow according to the preferred embodiment of this invention will be described below.

As shown in FIGS. 3 and 4, before the bowstring 140 is pulled, the contact pin 500 of the lower pulley assembly 108 is fixed and coupled in the coupling hole 503 at a position in contact with the lower limb 103 in the let-off state depending on the position of the cam module 220. Then, at the upper pulley assembly 107, the indicator 400 is disposed so that the contact protrusion 410 is located at one end of the guide hole 403 (toward the front end of the guide hole 403 in the direction where the pulley is rotated). When the bowstring 140 is pulled, the indicator 400 is rotated along with rotation of the pulley 110 at a state where position of the contact protrusion 410 is maintained in the guide hole 403, and when the contact protrusion 410 comes to contact the upper limb 104, the pulley 110 continues to rotate and thus the contact protrusion 410 is pushed by the upper limb 104 to thus be moved in the guide hole 403.

In addition, the contact pin 500 formed in the lower pulley assembly 108 is coupled and fixed in the coupling hole 503, and is rotated together with the pulley 110, while the position of the contact pin 500 is maintained. The contact pin 500 comes to contact the lower limb 103 in the let-off state.

That is, a state of a bow at a time when the bowstring 140 has been pulled, that is, at a let-off state where an arrow is shot is shown in FIGS. 6 and 7. FIG. 7 is a side view showing the compound bow when a bowstring 140 has been pulled in the case that the rotational angles of the respective cams 200 of the upper and lower pulley assemblies 107 and 108 are identical, in which a position where the indicator 400 is moved is consistent with position corresponding to the contact pin 500. The indicator 400 is formed to move in the guide hole 403 only by contact with the upper limb 104. Accordingly, the indicator 400 is located at an identical position even after the bowstring 140 has been released. Thus, a bowyer has released the bowstring 140 and then confirms that a position where the indicator 400 is moved in the guide hole 403 is consistent with position of the contact pin 500, to thereby see that the rotational angles of the upper and lower cams 200 are identical.

However, due to a difference in strength of the limbs, the rotational angles of the upper and lower cams 200 can vary until the let-off state. In a case that the rotational angle of the cam 200 of the upper pulley assembly 107 is larger than that of the cam 200 of the lower pulley assembly 108, since the rotational angle of the cam 200 of the upper pulley assembly 107 is larger than that of the cam 200 of the lower pulley assembly 108, the contact protrusion 402 of the indicator 400 is also moved more in the guide hole 403. Therefore, when a bowyer confirms that the movement position of the indicator 400 is moved more than the position of the contact pin 500, by comparing the movement position of the indicator 400 with the position of the contact pin 500, it can be seen that the rotational angle of the cam 200 coupled to the upper pulley assembly 107 is larger than that of the cam 200 coupled to the lower pulley assembly 108. In this case, when the length of the cam cable 150*a* wound on the cam 200 of the upper pulley assembly 107 is reduced, the rotational angle of the cam 200 can be reduced, to thus make the rotational angles of the upper and lower cams 200 identical.

Meanwhile, in the case that the rotational angle of the cam 200 of the upper pulley assembly 107 is smaller than that of the cam 200 of the lower pulley assembly 108, the contact protrusion 402 of the indicator 400 is also moved less in the guide hole 403. Therefore, when a bowyer confirms that the movement position of the indicator 400 is moved less than the position of the contact pin 500, by comparing the movement position of the indicator 400 with the position of the contact pin 500, it can be seen that the rotational angle of the cam 200 coupled to the upper pulley assembly 107 is smaller than that of the cam 200 coupled to the lower pulley assembly 108. In this case, when the length of the cam cable 150*a* wound on the cam 200 of the upper pulley assembly 107 is increased, the rotational angle of the cam 200 can be increased, to thus make the rotational angles of the upper and lower cams 200 identical.

In the present invention as described above, even when the rotational angles of the upper and lower cams 200 differ from each other, it can be seen easily by a bowyer alone that the rotational angles of the cams 200 are changed differently from each other. Therefore, the rotational angles of the upper and lower cams 200 can be made identical by adjusting the length of the cam cable 150*a*.

Figure 8:
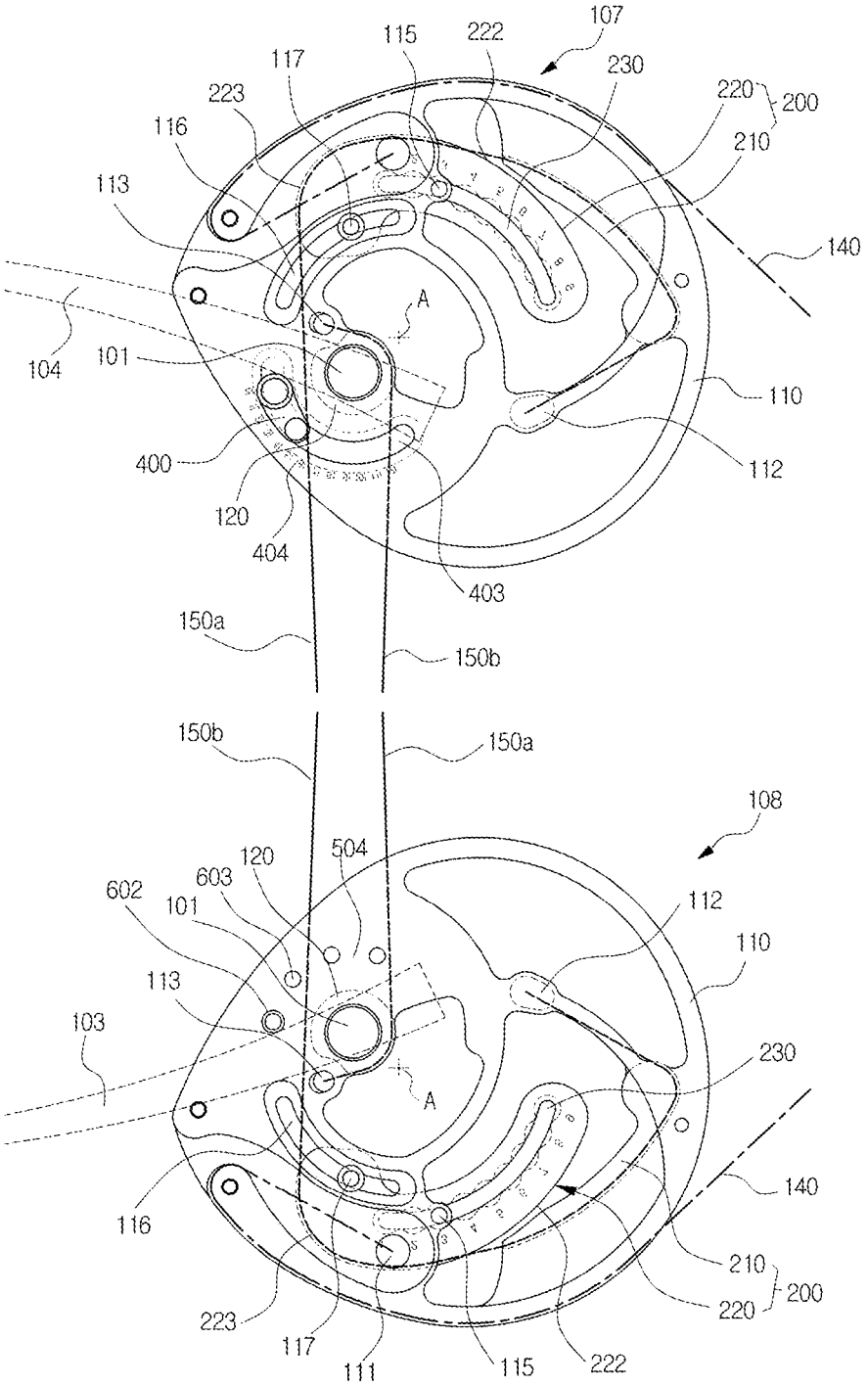
FIG. 8 is a side view showing another example of a contact pin and a coupling hole in FIG. 7.

Meanwhile, FIG. 8 illustrates another example of a coupling hole unit to which a contact pin 602 is coupled. In FIG. 8, the coupling hole unit is configured to have a plurality of coupling holes 603 that are formed at regular intervals, in which the contact pin 602 is coupled to one of the plurality of coupling holes 603.

Determination of one of the coupling holes 603 to which the contact pin 602 is coupled, is changed according to a position to which the cam module 220 is moved from the cam cable winding portion 210. In addition, the contact pin 602 is coupled to one of the coupling holes 603 by selecting the one of the coupling holes 603 that makes the contact pin 602 contact the lower limb 103 in the let-off state at a position where the cam module 220 has been changed.

Here, a detailed description of other configurations and operational effects of the second embodiment similar to those of the first embodiment will be omitted.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. A self-tunable compound bow comprising:

a bow main body including a handle at a central portion of which a grip portion is provided and a pair of limbs that are respectively coupled to opposite ends of the handle;

upper and lower pulley assemblies each including a pulley that is rotatably coupled to a rotating shaft provided on the rear end of each limb, and a cam that is coupled to one side of the pulley for rotating with the pulley;

a bowstring comprising opposite ends respectively wound and coupled to the pulleys of the upper and lower pulley assemblies;

first and second cam cables that wind around the cam of each of the upper and lower pulley assemblies as the bowstring is pulled, in which one end of each of the first and second cam cables is coupled to one of the upper and lower pulley assemblies, and the other end of the first and second cam cables is coupled to the other of the upper and lower pulley assemblies;

a contact pin operatively coupled to an coupling hole of the pulley of the one of the pulley assemblies to rotate together with the pulley while remaining fixed in the arcuate coupling hole until coming into contact with one limb to which the one of the pulley assemblies is coupled during pulling of the bowstring towards a let-off state, wherein the contact of the contact pin with the one limb causes the contact pin to move lengthwise along the arcuate coupling hole during further pulling of the bowstring to the let-off state; and an indicator operatively coupled to an arcuate guide hole of the pulley of the other of the pulley assemblies to rotate together with the pulley of the other of the pulley assemblies while remaining fixed in the arcuate guide hole until coming into contact with the other limb to which the other of the pulley assemblies is coupled during the pulling of the bowstring toward the let-off state, wherein the contact of the indicator with the other limb causes the indicator to move lengthwise along the arcuate guide hole during the further pulling of the bowstring to the let-off state.

2. The self-tunable compound bow of claim 1, wherein:

the contact pin is positioned in a first position in the arcuate coupling hole after the further pulling of the bowstring to the let-off state, and the contact pin remains in the first position after release of the bowstring from the let-off state; and the indicator is positioned in a second position in the arcuate guide hole after the further pulling of the bowstring to the let-off state, and the indicator remains in the second position after release of the bowstring from the let-off state.

3. The self-tunable compound bow of claim 1, wherein the guide hole is associated with a position display that displays a position to which the indicator moves during the further pulling of the bowstring to the let-off state.

4. The self-tunable compound bow of claim 1, wherein the indicator comprises a contact protrusion and a support member that are coupled to each other at both side surface of the guide hole, and the contact protrusion that contacts the other limb and the support member are coupled by two coupling members that are spaced apart from each other at a certain gap along the guide hole.

5. The self-tunable compound bow of claim 2, wherein the compound bow is self-tunable by comparing the first position of the contact pin after release of the bowstring from the let-off state with the second position of the indicator after the release of the bowstring from the let-off state.

6. The self-tunable compound bow of claim 4, wherein a contact rubber pad is provided between the contact protrusion and the support member of the indicator, in which the contact rubber pad contacts the guide hole, thus the indicator maintains an original position within the guide hole before the indicator contacts the other limb.

7. The self-tunable compound bow of claim 4, wherein one of the two coupling members is a bolt that couples the contact protrusion and the support member detachably.

8. The self-tunable compound bow of claim 7, wherein the other of the two coupling members is a coupling pin that is formed in the support member, and the coupling pin is inserted into and coupled to an insertion hole formed in the contact protrusion.

9. A self-tunable compound bow, comprising:

a bow main body including a handle at a central portion of which a grip portion is provided and a pair of limbs that are respectively coupled to opposite ends of the handle;

upper and lower pulley assemblies each including a pulley that is rotatably coupled to a rotating shaft provided on the rear end of each limb, and a cam that is coupled to one side of the pulley for rotating with the pulley;

a bowstring comprising opposite ends respectively wound and coupled to the pulleys of the upper and lower pulley assemblies;

first and second cam cables that wind around the cam of each of the upper and lower pulley assemblies as the bowstring is pulled, in which one end of each of the first and second cam cables is coupled to one of the upper and lower pulley assemblies, and the other end of the first and second cam cables is coupled to the other of the upper and lower pulley assemblies;

a contact pin coupled to a coupling hole of the pulley of the one of the pulley assemblies to come into contact with one limb to which the one of the pulley assemblies is coupled when the bowstring is pulled towards the let-off state; and an indicator operatively coupled to an arcuate guide hole of the pulley of the other of the pulley assemblies to rotate together with the pulley of the other of the pulley assemblies while remaining fixed in the arcuate guide hole until coming into contact with the other limb to which the other of the pulley assemblies is coupled during pulling of the bowstring toward the let-off state, wherein the contact of the indicator with the other limb causes the indicator to move lengthwise along the arcuate guide hole during further pulling of the bowstring to the let-off state, wherein the indicator comprises a contact protrusion and a support member that are coupled to each other at both side surface of the guide hole, and the contact protrusion that contacts the other limb and the support member are coupled by two coupling members that are spaced apart from each other at a certain gap along the guide hole.

10. The self-tunable compound bow of claim 9, wherein the pulley of the one of the pulley assemblies comprises at least one additional coupling hole to establish a plurality of coupling holes, wherein the contact pin is coupled to one of the plurality of the coupling holes.

11. The self-tunable compound bow of claim 9, wherein the indicator is positioned in a position in the arcuate guide hole after the further pulling of the bowstring to the let-off state, and the indicator remains in the identical position after release of the bowstring from the let-off state.

12. The self-tunable compound bow of claim 9, wherein the guide hole is associated with a position display that displays a position to which the indicator moves during the further pulling of the bowstring to the let-off state.

13. The self-tunable compound bow of claim 9, wherein a contact rubber pad is provided between the contact protrusion and the support member of the indicator, in which the contact rubber pad contacts the guide hole, and thus the indicator maintains an original position within the guide hole before the indicator contacts the other limb.

14. The self-tunable compound bow of claim 9, wherein one of the two coupling members is a bolt that couples the contact protrusion and the support member detachably.

15. The self-tunable compound bow of claim 14, wherein the other of the two coupling members is a coupling pin that is formed in the support member, and the coupling pin is inserted into and coupled to an insertion hole formed in the contact protrusion.

* * * * *